US008955710B2

(12) United States Patent
Dotson

(10) Patent No.: US 8,955,710 B2
(45) Date of Patent: Feb. 17, 2015

(54) WASTE CONTAINER STABILIZATION SYSTEM

(71) Applicant: Lane Edison Dotson, Colorado Springs, CO (US)

(72) Inventor: Lane Edison Dotson, Colorado Springs, CO (US)

( * ) Notice: Subject to any disclaimer, the term of this patent is extended or adjusted under 35 U.S.C. 154(b) by 0 days.

(21) Appl. No.: 14/492,995
(22) Filed: Sep. 22, 2014

(65) Prior Publication Data

US 2015/0008226 A1 Jan. 8, 2015

Related U.S. Application Data

(60) Provisional application No. 61/883,573, filed on Sep. 27, 2013.

(51) Int. Cl.
*B65F 1/06* (2006.01)
*B65F 1/14* (2006.01)

(52) U.S. Cl.
CPC ..... *B65F 1/068* (2013.01); *B65F 1/141* (2013.01); *B65F 2210/179* (2013.01); *B65F 2210/181* (2013.01); *B65D 2313/06* (2013.01)
USPC ..... 220/630; 220/495.06

(58) Field of Classification Search
CPC .... B65D 2313/06; B65D 25/24; B65F 1/065; B65F 1/06; B65F 1/04; B65F 1/141; B65F 1/068
USPC ..... 220/483, 481, 480, 630, 628, 908.1, 220/908, 495.06, 495.01, 605, 606; 248/154, 149, 146, 127
See application file for complete search history.

(56) References Cited

U.S. PATENT DOCUMENTS

| | | | | |
|---|---|---|---|---|
| 2,969,890 | A * | 1/1961 | Udell | 220/605 |
| 4,562,983 | A | 1/1986 | Klefbeck | |
| 4,580,751 | A | 4/1986 | Panzer | |
| 5,375,732 | A | 12/1994 | Bowers | |
| 5,388,717 | A | 2/1995 | Levasseur | |
| 6,241,091 | B1 | 6/2001 | Moore | |
| 6,550,735 | B1 | 4/2003 | Zheng | |
| 7,285,928 | B1 | 10/2007 | Jolly | |
| 7,438,199 | B1 | 10/2008 | Tidrick | |
| 7,757,881 | B1 | 7/2010 | Riley | |
| 8,356,781 | B2 | 1/2013 | Chen | |
| 8,517,209 | B2 | 8/2013 | Finell | |
| 2011/0000925 | A1 | 1/2011 | Okamoto | |
| 2012/0087600 | A1 | 4/2012 | Bahojbalmasi | |

* cited by examiner

*Primary Examiner* — Robert J Hicks

(57) ABSTRACT

A waste container stabilization system for stabilizing a waste container for easy insertion and removal of trash bags. The waste container stabilization system generally includes a container having a base, at least one sidewall extending upwardly from the base and an interior cavity formed by the base and the at least one sidewall, wherein the at least one sidewall has an upper edge surrounding an upper opening within the container, and wherein the at least one sidewall, and at least one suction cup attached to a bottom surface of the base, wherein the at least one suction cup is removably attachable to an upper surface of a floor using negative fluid pressure.

20 Claims, 13 Drawing Sheets

WASTE CONTAINER STABILIZATION SYSTEM

CROSS REFERENCE TO RELATED APPLICATIONS

I hereby claim benefit under Title 35, United States Code, Section 119(e) of U.S. provisional patent application Ser. No. 61/883,573 filed Sep. 27, 2013. The 61/883,573 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a waste container and more specifically it relates to a waste container stabilization system for stabilizing a waste container for easy insertion and removal of trash bags.

2. Description of the Related Art

Any discussion of the related art throughout the specification should in no way be considered as an admission that such related art is widely known or forms part of common general knowledge in the field.

Conventional waste containers are comprised of a container having at least one wall, a floor and an upper edge defining an upper opening exposing an interior cavity that receives a trash bag. Conventional waste containers may also include a lid that is pivotally attached to the container or removably positionable upon the container to selectively cover the interior cavity along with the trash bag and the waste in the trash bag. Conventional waste containers are constructed of various types of materials such as plastic and metal to prevent leakage if the trash bag has a leak.

One problem with conventional waste containers is that when inserting a trash bag into the container and overlapping the trash bag over the upper edge of the container, the trash bag forms a seal with the upper edge of the container creating a pressurized air pocket around the trash bag. The pressurized air pocket prevents the user from inserting waste into the container without the trash bag losing attachment around the upper edge. Another problem is that when removing a trash bag from a waste container, a vacuum is created around the side of the trash bag during removal making it extremely difficult to remove the trash bag. Furthermore, when removing a trash bag full of waste material, the container may move or lift upwardly with the trash bag further creating problems for the user attempting to remove the trash bag.

Because of the inherent problems with the related art, there is a need for a new and improved waste container stabilization system for stabilizing a waste container for easy insertion and removal of trash bags.

BRIEF SUMMARY OF THE INVENTION

The invention generally relates to a waste container which includes a base, at least one sidewall extending upwardly from the base and an interior cavity formed by the base and the at least one sidewall, wherein the at least one sidewall has an upper edge surrounding an upper opening within the container, and wherein the at least one sidewall, and at least one suction cup attached to a bottom surface of the base, wherein the at least one suction cup is removably attachable to an upper surface of a floor using negative fluid pressure.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
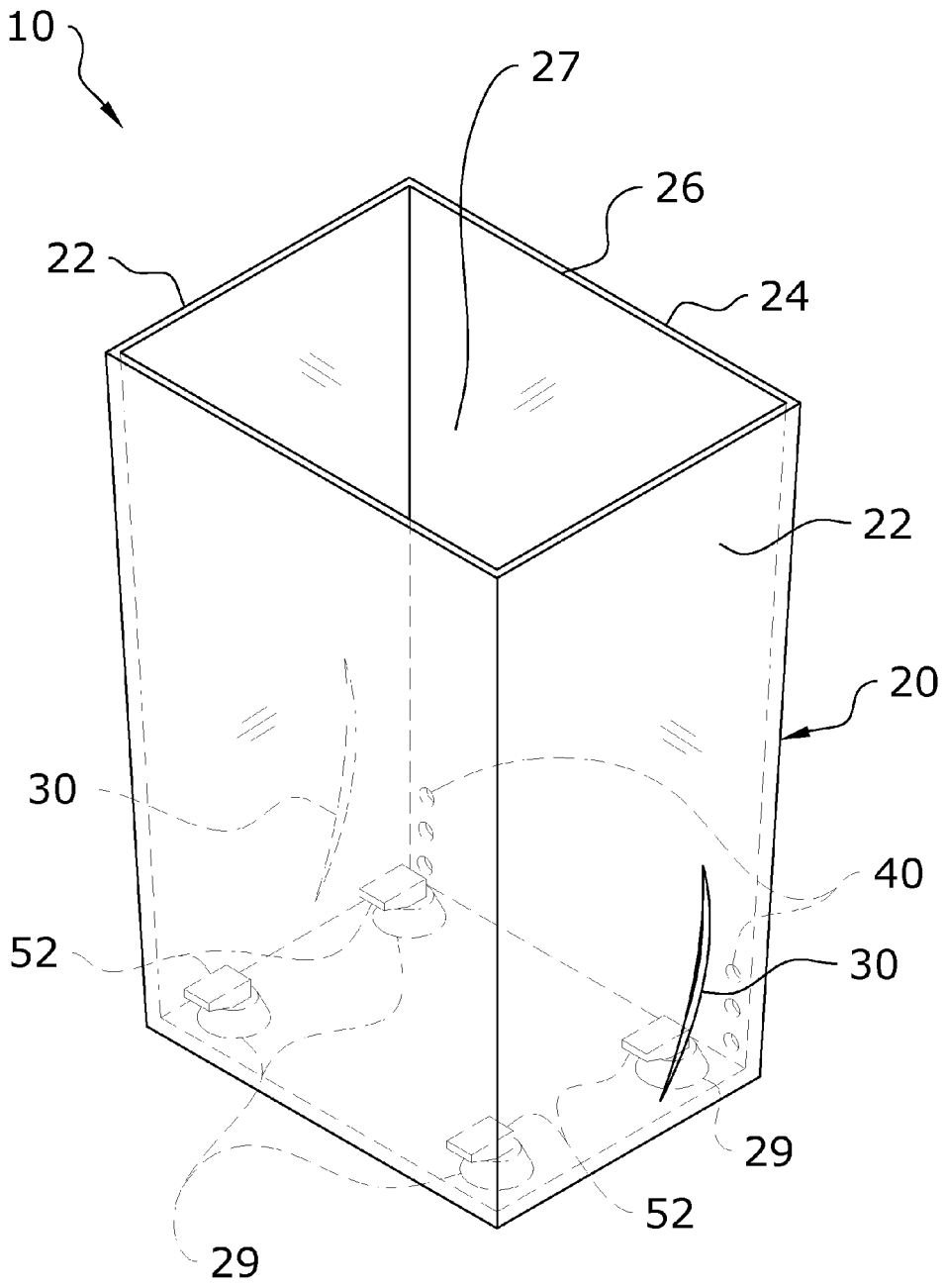
FIG. 1 is an upper perspective view of the present invention.

A. Overview.

Turning now descriptively to the drawings, in which similar reference characters denote similar elements throughout the several views, FIGS. 1 through 14 illustrate a waste container stabilization system 10, which comprises a base 28, at least one sidewall 22 extending upwardly from the base 28 and an interior cavity 27 formed by the base 28 and the at least one sidewall 22, wherein the at least one sidewall 22 has an upper edge 24 surrounding an upper opening 26 within the container 20, and wherein the at least one sidewall 22, and at least one suction cup 50 attached to a bottom surface of the base 28, wherein the at least one suction cup 50 is removably attachable to an upper surface of a floor 12 using negative fluid pressure.

B. Container.

Figure 6:
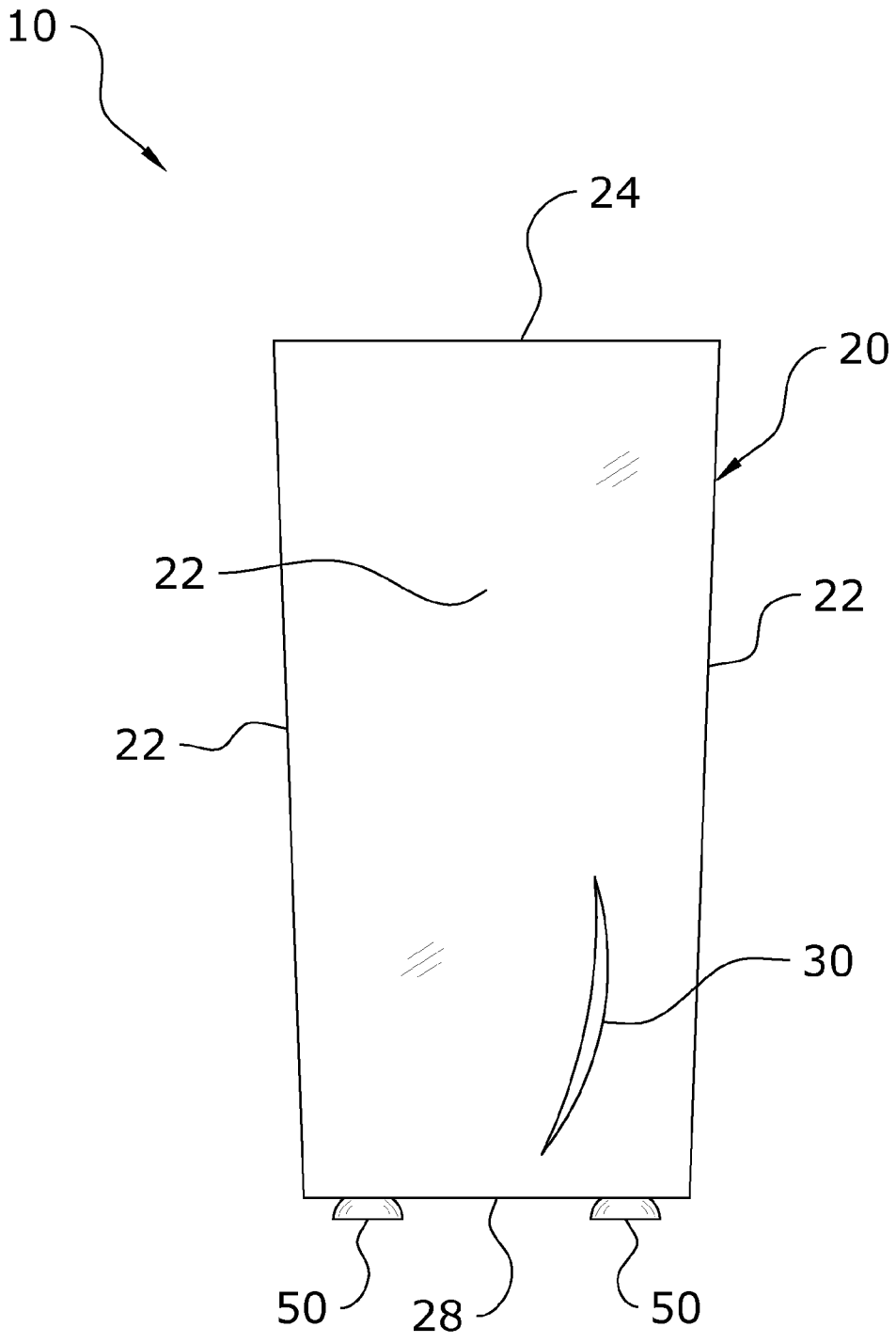
FIG. 6 is a right side view of the present invention.
Figure 7:
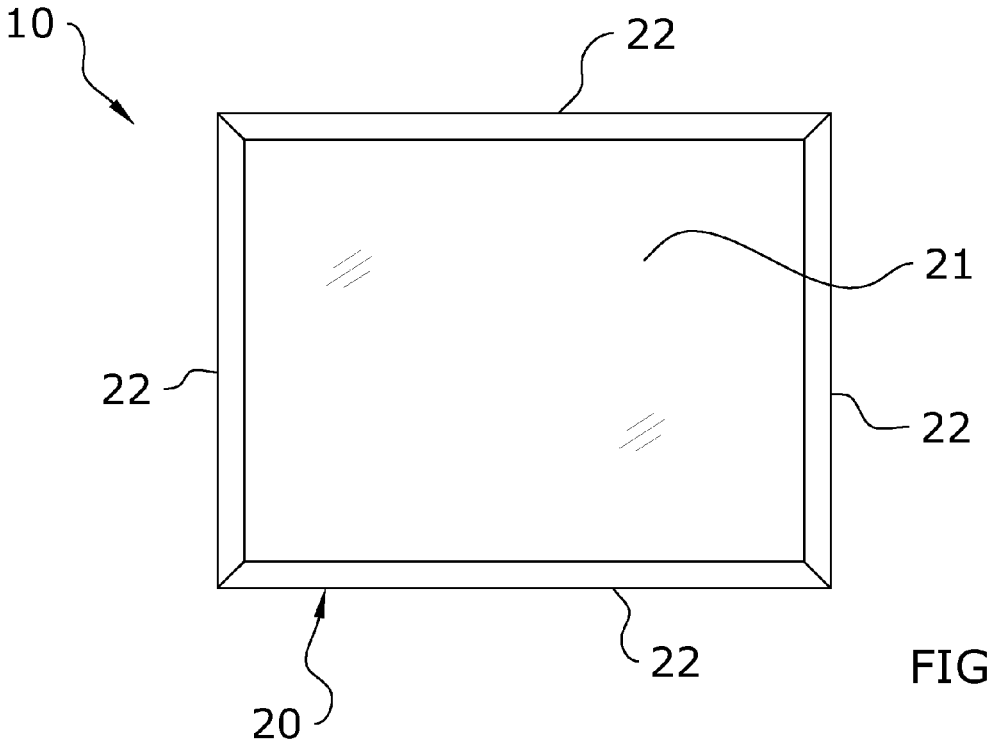
FIG. 7 is a top view of the present invention with a cover positioned upon the upper opening of the container.

FIGS. 1 through 14 illustrate an exemplary container 20 having a base 28, at least one sidewall 22 extending upwardly from the base 28 and an interior cavity 27 formed by the base 28 and the at least one sidewall 22. The container 20 is constructed of a non-permeable material such as plastic or metal. The sidewall 22 also has an upper edge 24 surrounding an upper opening 26 within the container 20. The upper opening 26 is opposite of the base 28 of the container 20 and the upper opening 26 typically has the shape of the cross section of the at least one sidewall 22. The container 20 may be comprised of any shape, structure and configuration used for a conventional waste container 20. The container 20 may have a pivotally attached or removably attached cover 21 to selectively enclose the interior cavity 27 as illustrated in FIG. 7 of the drawings.

The base 28 is comprised of a flat and horizontal structure as illustrated in FIGS. 1, 2 and 11 through 14 of the drawings. The base 28 may be the same size and shape as the upper opening 26 or different. The base 28 and the at least one sidewall 22 are both preferably non-permeable to prevent leakage of liquids.

The at least one sidewall 22 may be comprised of one sidewall 22 (e.g. circular or oval shaped structure) or two or more sidewalls 22 connected together and connected to the base 28. FIGS. 1, 2, 8 and 9 illustrate a container 20 having four sidewalls 22 connected together forming a tubular structure having a rectangular cross sectional area comprised of a left sidewall, a right sidewall, a front sidewall and a rear sidewall. Various other configurations may be used for the container 20.

The base 28 preferably includes at least one recessed portion 29 extending upwardly into the bottom surface that is adapted to receive at least a portion of the at least one suction cup 50. The at least one recessed portion 29 is preferably comprised of the same number of suction cups 50 used (e.g. if four suction cups 50 are used, then four recessed portions 29 extend into the base 28). The recessed portions 29 are preferably comprised of the same shape as the suction cups 50 (e.g. circular). The recessed portions 29 of the base 28 extend upwardly into the interior cavity 27 of the cavity above the upper surface of the base 28 as best illustrated in FIGS. 11 through 14 of the drawings.

Figure 8:
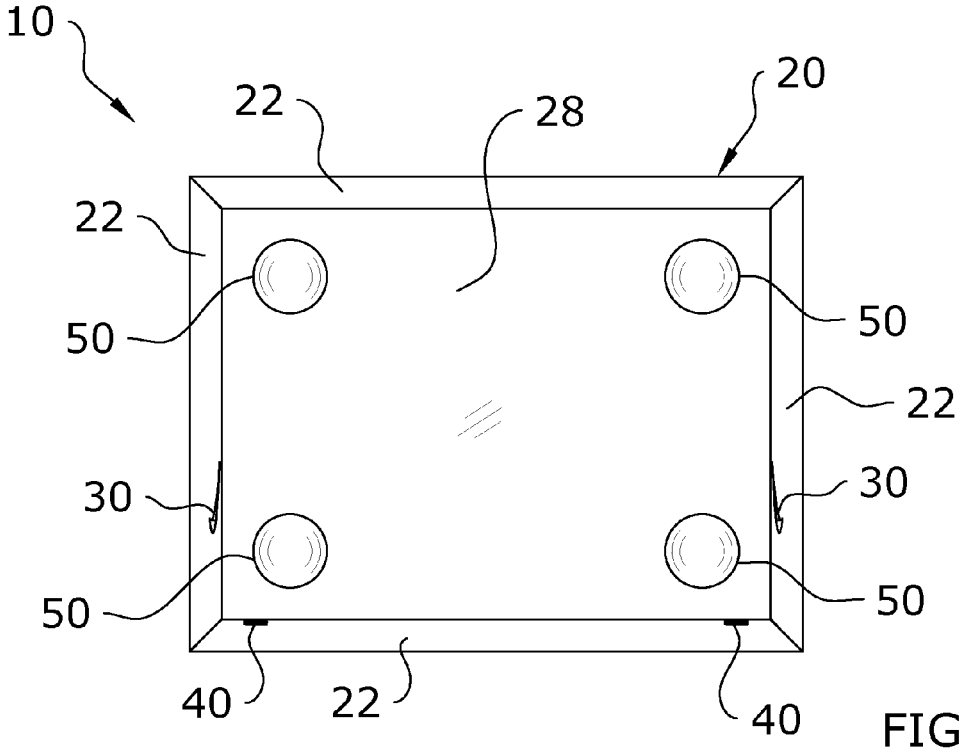
FIG. 8 is a bottom view of the present invention.
Figure 9:
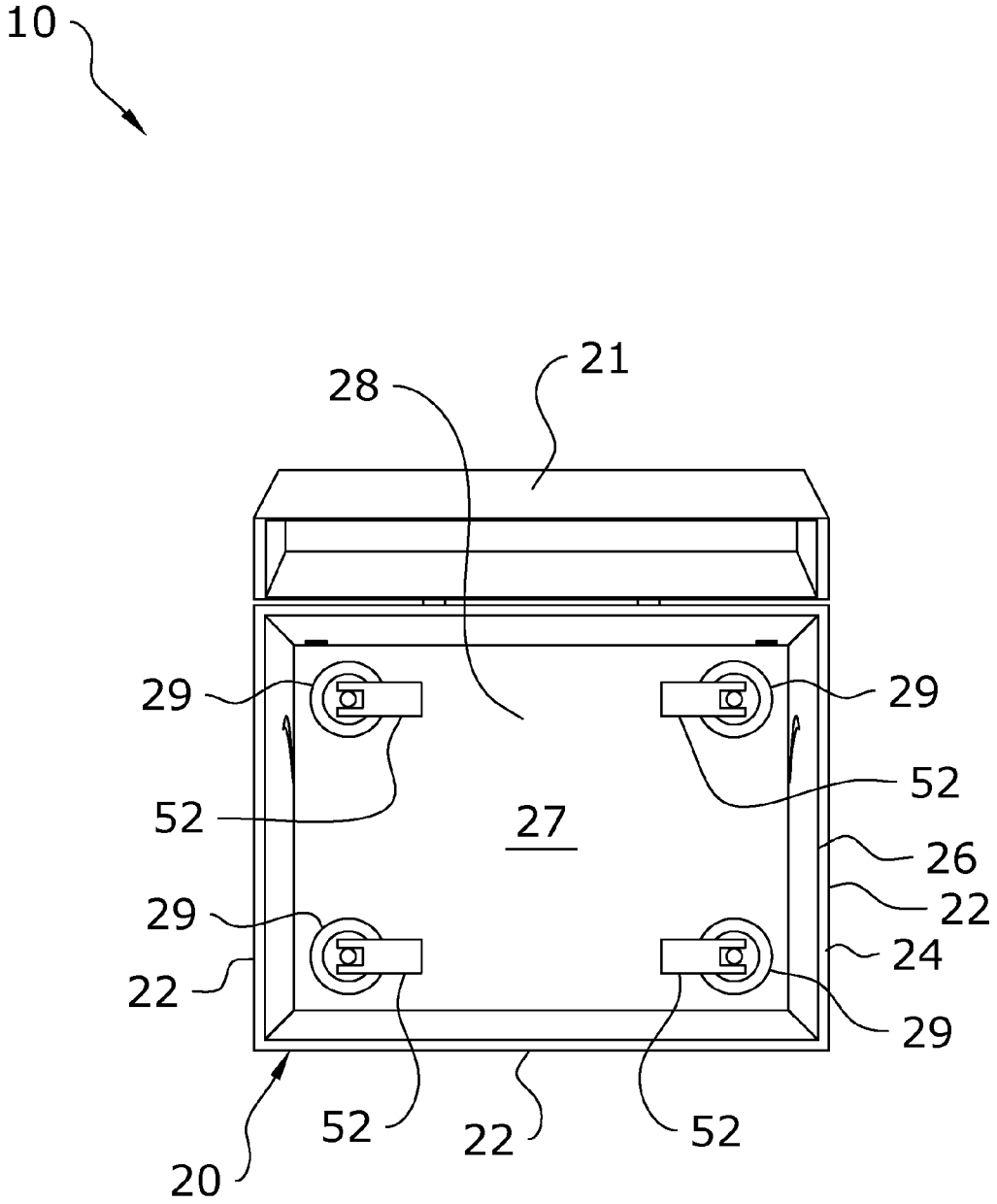
FIG. 9 is a top view of the present invention showing the levers for the suction cups.
Figure 10:
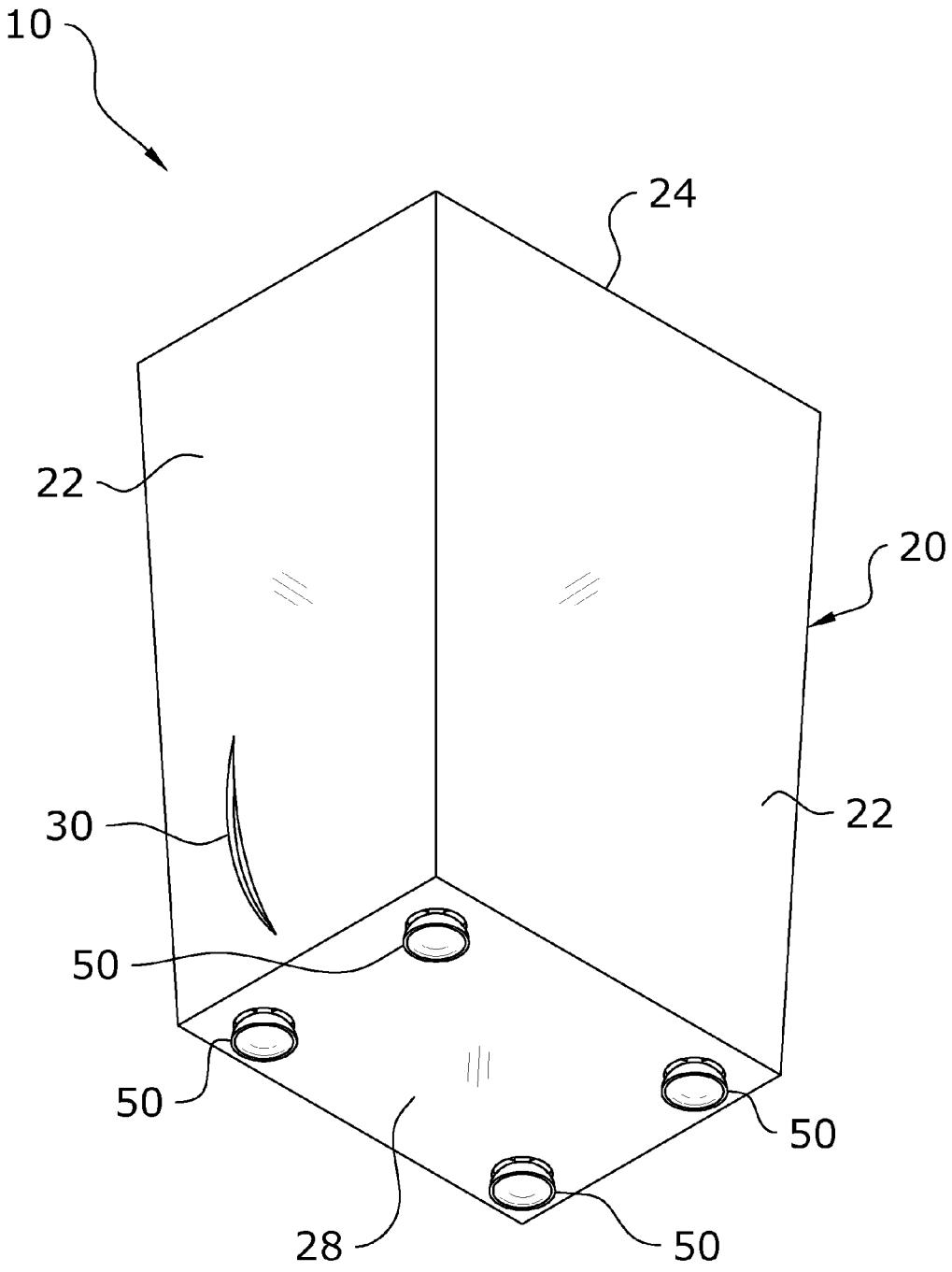
FIG. 10 is a lower perspective view of the present invention.

The base 28 is preferably comprised of a rectangular shaped structure having four corners as illustrated in FIGS. 8, 9 and 10 of the drawings. The present invention preferably utilizes at least four suction cups 50 which are attached to the bottom surface of the base 28 near each of the four corners of the base 28 as illustrated in FIGS. 8, 9 and 10 of the drawings. Utilizing at least four suction cups 50 (i.e. 4, 5, 6 or more) provides increased stability to the container 20, particularly for containers 20 that have a sidewall 22 that is taller than the width of the base 28 as illustrated in FIGS. 3 through 6 of the drawings. If the container 20 is a shorter height (e.g. shorter in length than the width of the base 28), then a lesser number of suction cups 50 may be utilized (e.g. 1, 2 or 3).

C. Suction Cup(s).

The present invention utilizes at least one suction cup 50 attached to the bottom surface of the base 28 and extends downwardly from the base 28. As discussed previously, it is preferable to utilize a plurality of suction cups 50 for increased stability and it is further preferable to utilize at least four suction cups 50 near each of the corners of the base 28 as illustrated in FIG. 10 of the drawings. For the purposes of the invention, a plurality of suction cups 50 will be discussed while it can be appreciated that a single suction cup 50 may also be utilized.

The suction cups 50 are removably attachable to an upper surface of a floor 12 using negative fluid pressure such as negative air pressure. The suction cups 50 may be comprised of conventional suction cups 50 without an actuator (i.e. the negative air pressure is created by pushing down on the suction cups 50 forcing the suction cups 50 to flatten and then release the suction cups 50 whereby the expansion of the suction cups 50 creates a negative air pressure in the air pockets formed between the suction cups 50 and the floor 12).

Alternatively, the suction cups 50 may be comprised of lever 52 actuated suction cups 50 wherein a lever 52 (e.g. handle, knob, arm) is connected to the suction cups 50. A lever 52 actuated suction cup 50 has the advantage of being able to create an increased negative air pressure compared to a non-lever 52 actuated suction cup 50. U.S. Pat. No. 4,580,751 (Panzer), U.S. Pat. No. 8,356,781 (Chen et al.) and U.S. Pat. No. 6,550,735 (Zheng) all disclose exemplary lever 52 actuated suction cups 50 with levers 52 that are suitable for usage in the present invention and are hereby incorporated by reference herein.

As illustrated in FIGS. 11 through 14 of the drawings, the lever 52 is positioned above the upper surface of the base 28. The lever 52 engages the upper surface of the base 28 when in the locked position to pull upwardly upon the at least one suction cup 50 and more particularly engages the upper end of the corresponding recessed portion 29 when in the locked position to create the negative air pressure in the suction cup 50. The lever 52 may be positioned outside of the container 20, however it is preferable that the lever 52 is positioned within the interior cavity 27 of the container 20 as illustrated in FIGS. 9 and 11 through 14 of the drawings.

Figure 11:
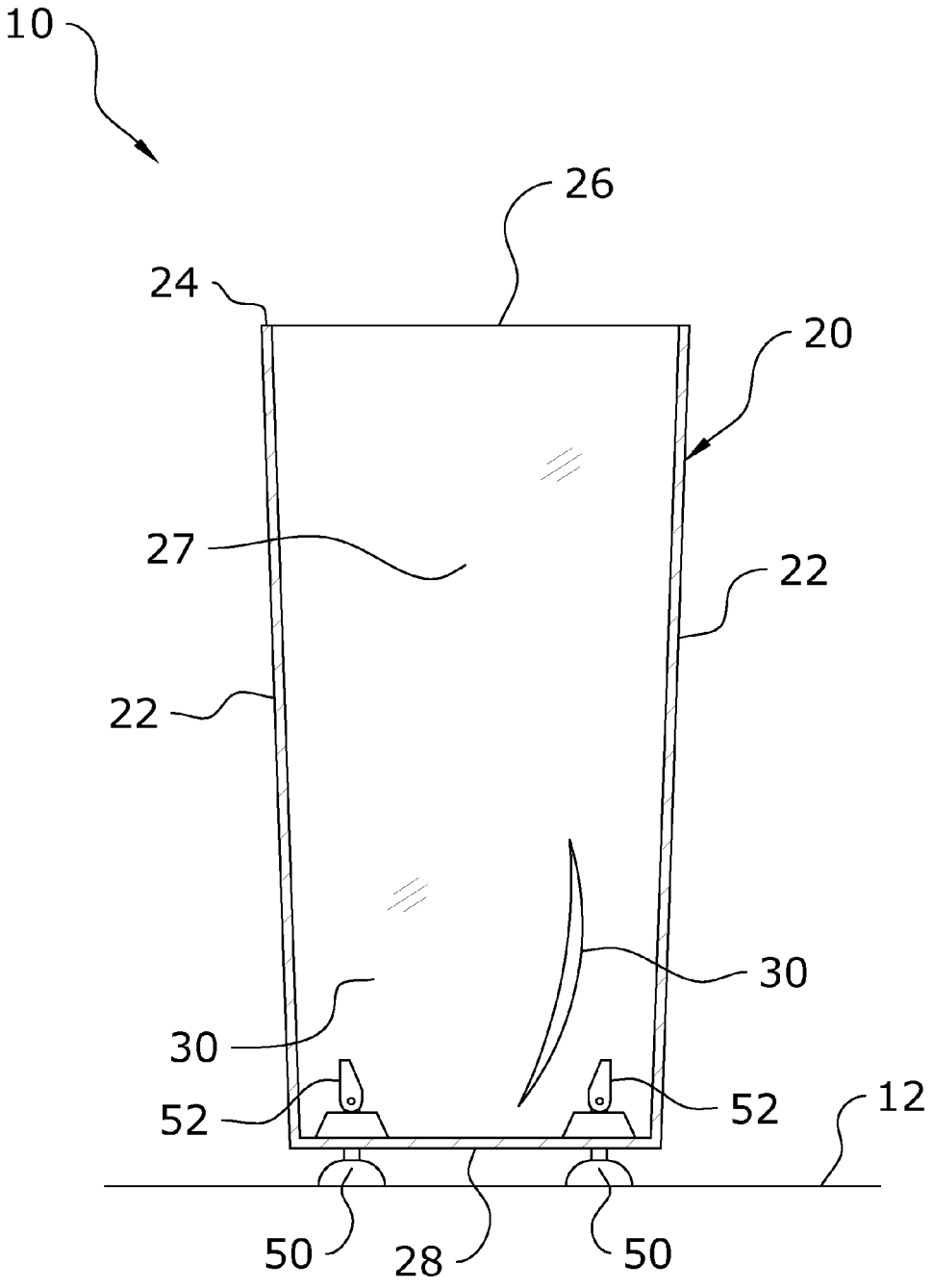
FIG. 11 is a cross sectional view taken along line 11-11 of FIG. 4 with the levers for the suction cups in the released position to allow for movement of the container with respect to a floor.
Figure 12:
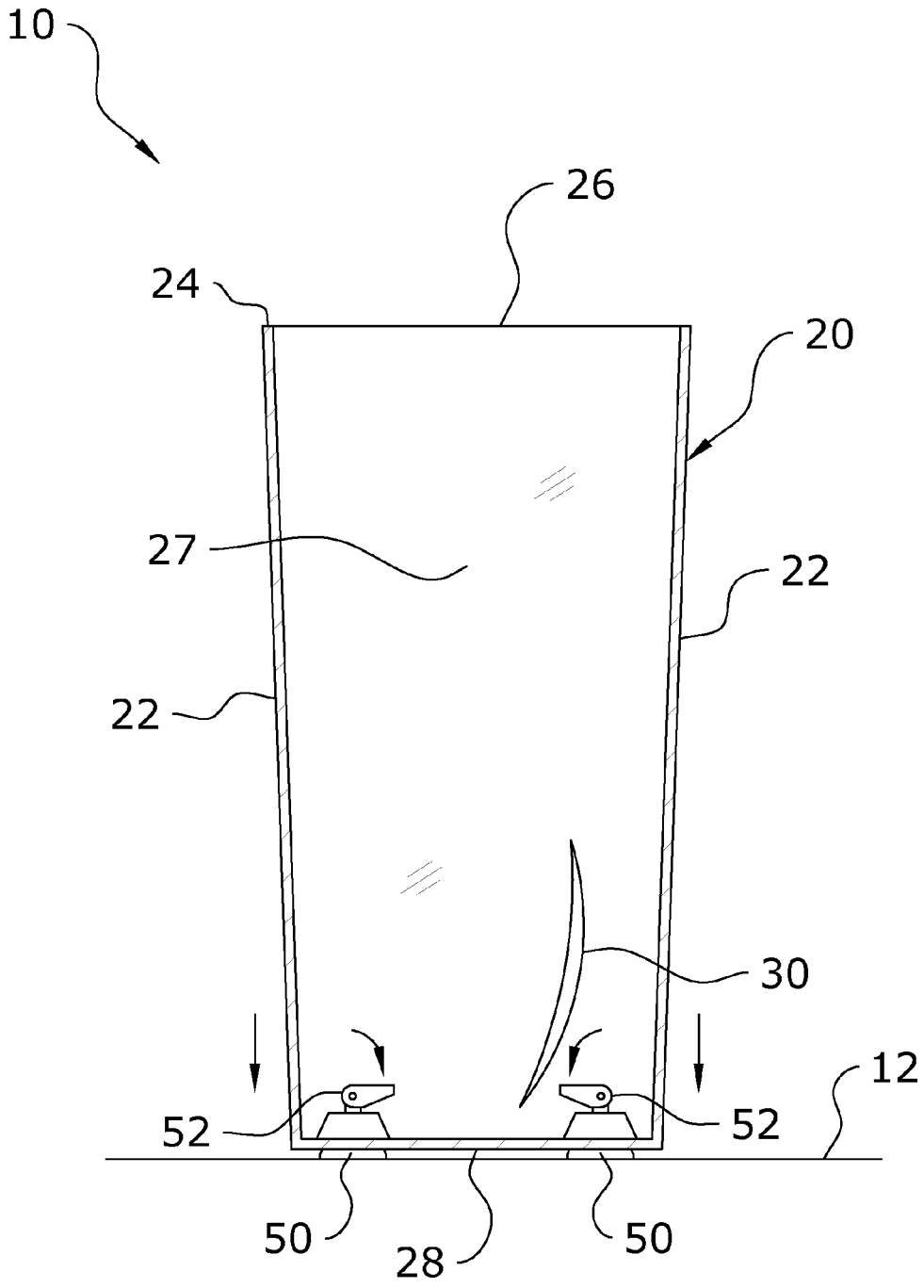
FIG. 12 is a cross sectional view taken along line 11-11 of FIG. 4 with the levers for the suction cups in the locked position to prevent movement of the container with respect to a floor.
Figure 13:
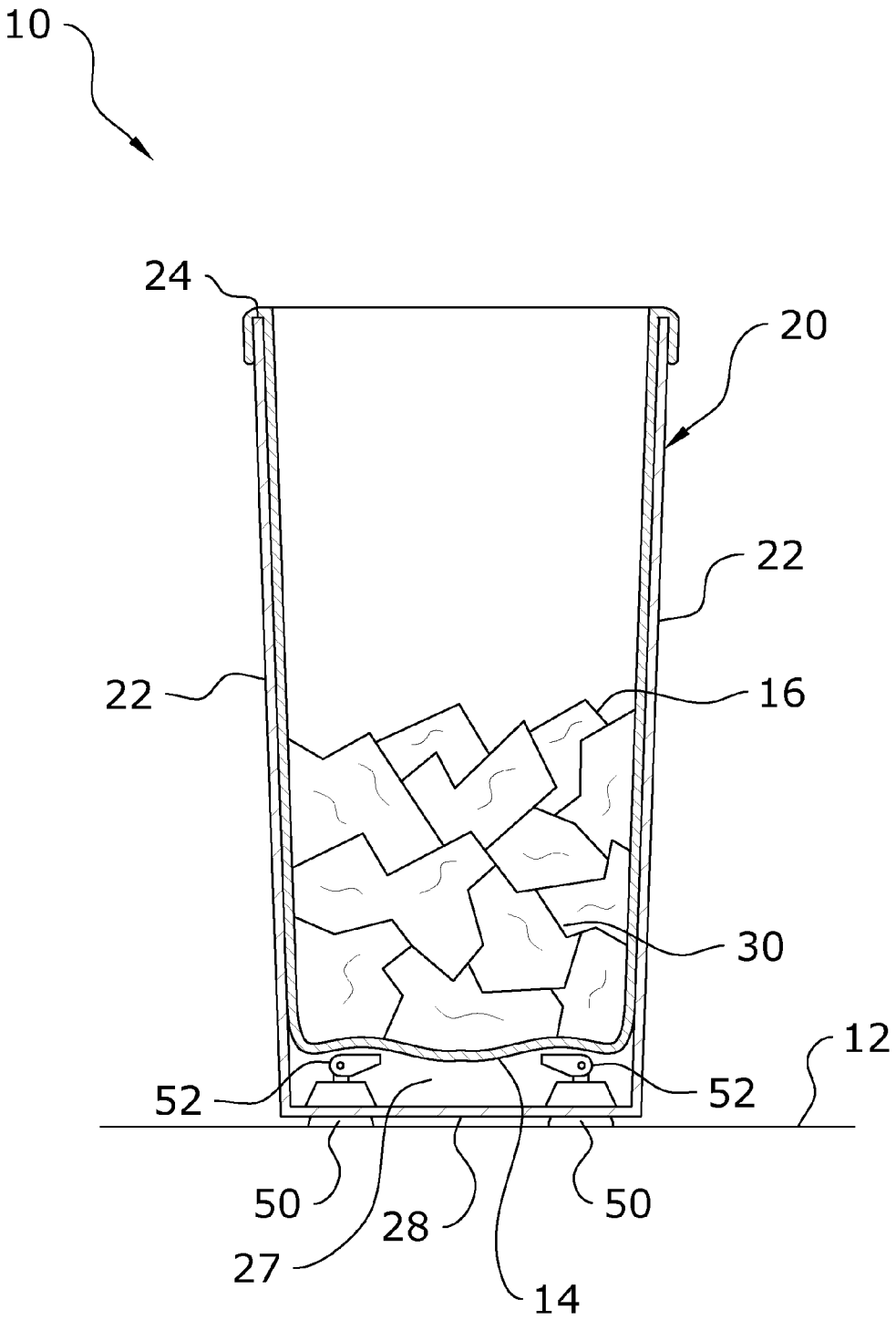
FIG. 13 is a cross sectional view taken along line 11-11 of FIG. 4 with the levers for the suction cups in the locked position to prevent movement of the container with respect to a floor and with a trash bag inserted within the interior cavity of the container.
Figure 14:
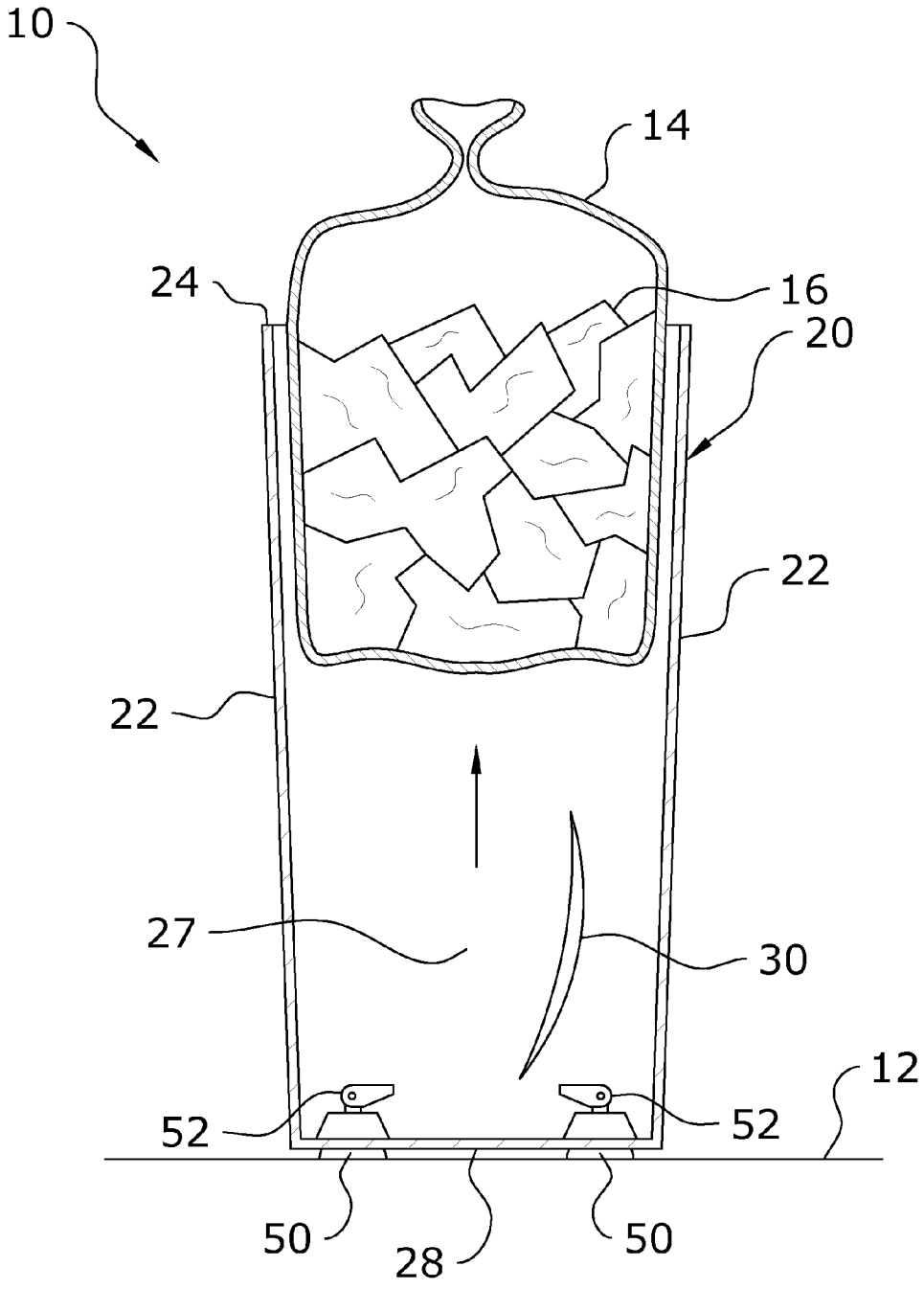
FIG. 14 is a cross sectional view taken along line 11-11 of FIG. 4 with the levers for the suction cups in the locked position to prevent movement of the container with respect to a floor and a trash bag partially removed from the container.

The lever 52 is positionable in a released position to allow for the release of the suction cup 50 from the floor 12 by releasing any negative fluid pressure within the suction cup 50 as illustrated in FIG. 11 of the drawings. The lever 52 is also positionable in a locked position to create a negative fluid pressure within the suction cup 50 to secure the suction cup 50 to the floor 12 using negative air pressure as illustrated in FIGS. 12 through 14 of the drawings. The lever 52 is further preferably comprised of an elongated handle as illustrated in FIG. 9 of the drawings to provide lever 52 age, however the lever 52 may be comprised of other structures.

D. Vent(s).

The container 20 preferably includes at least one vent 30, 40 within a lower portion of the container 20 such as the base 28 or the sidewall 22 to allow for air to escape from the interior cavity 27 of the container 20 when inserting a trash bag 14 and for air to enter the interior cavity 27 of the container 20 when removing the trash bag 14. The at least one vent 30, 40 is preferably positioned within the sidewall 22 at least one inch above the upper surface of the base 28 to prevent the leakage of fluids from the trash bag 14 due to wet waste material 16.

Figure 2:
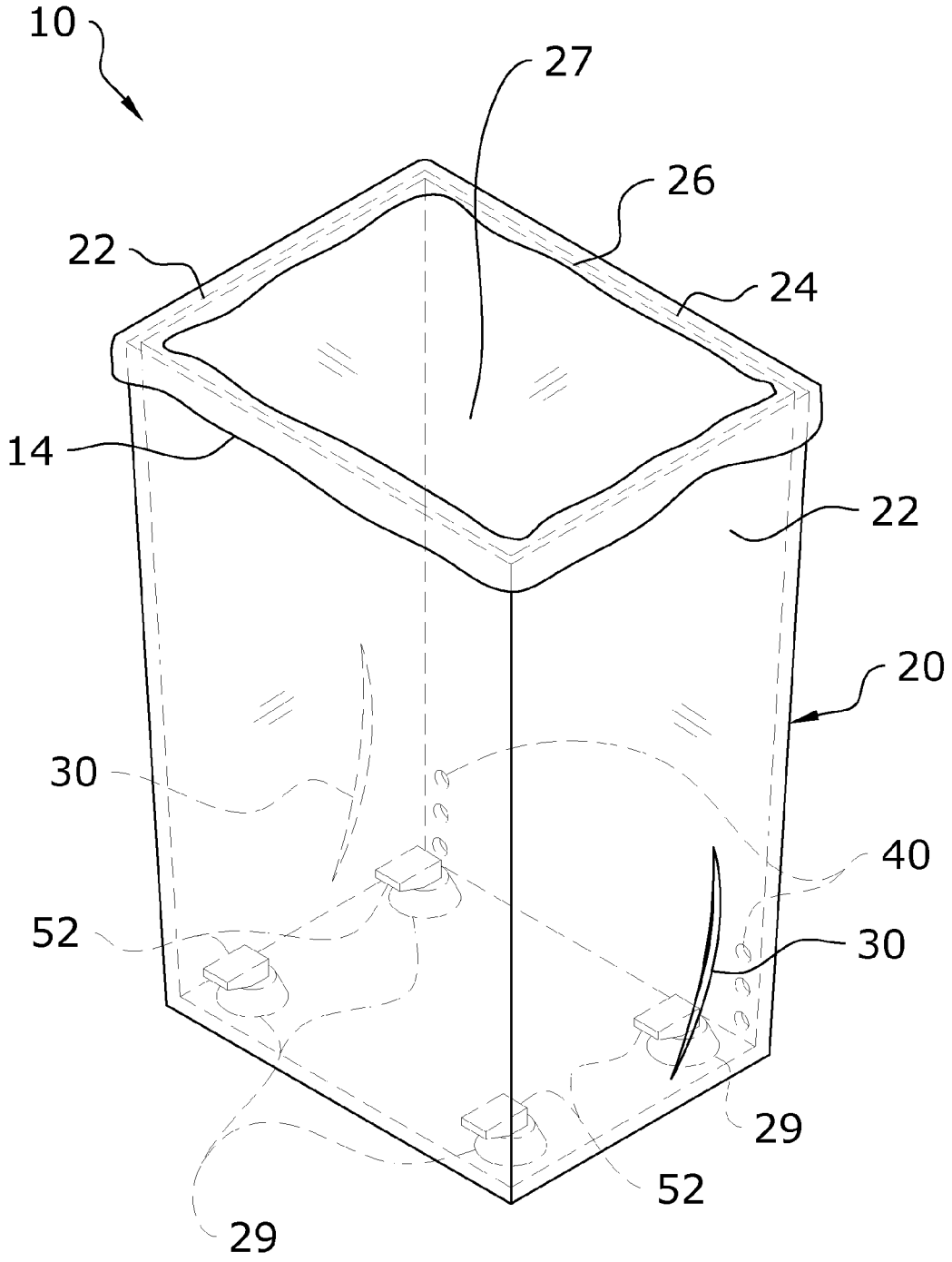
FIG. 2 is an upper perspective view of the present invention with a trash bag inserted within the container.
Figure 3:
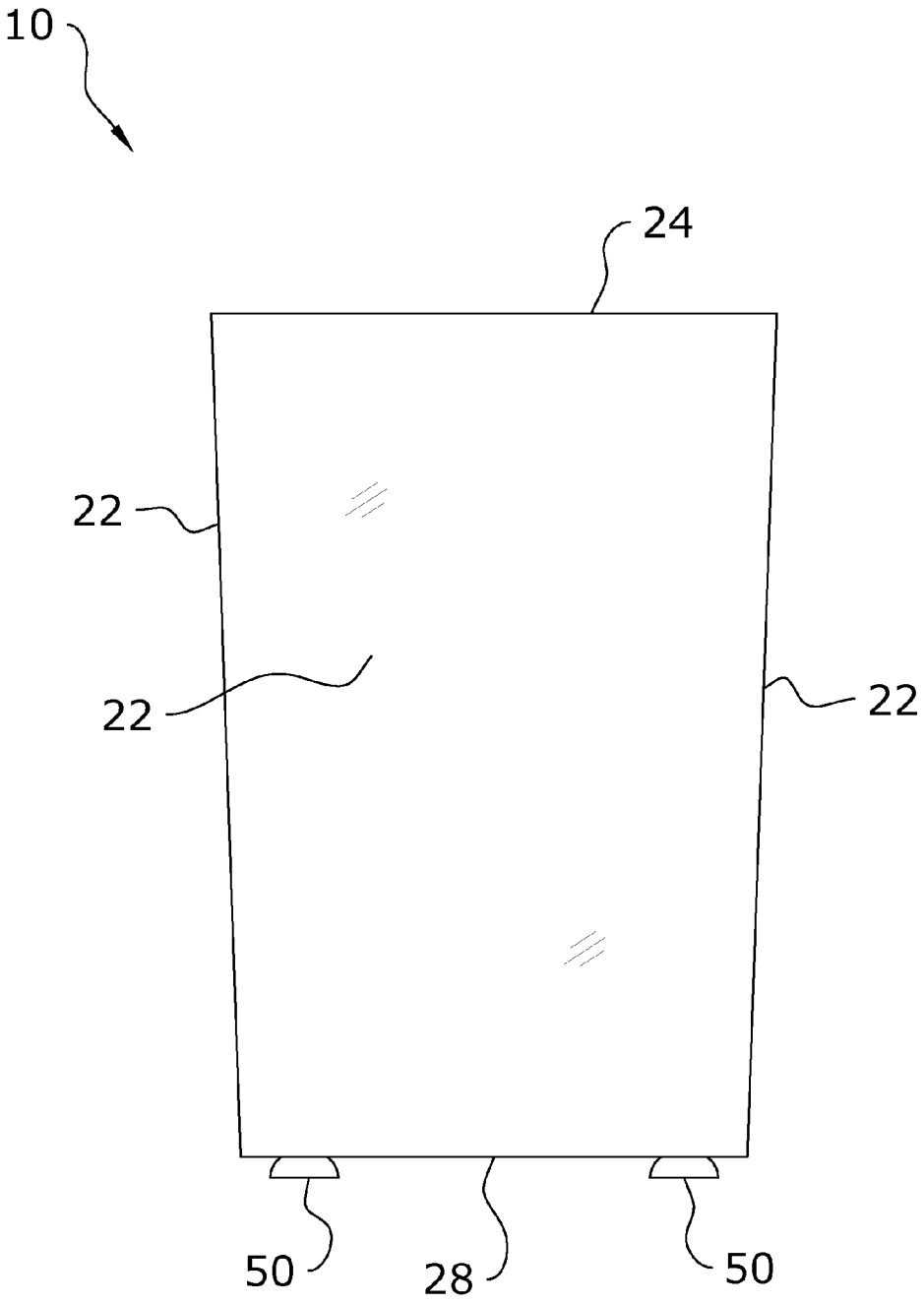
FIG. 3 is a front view of the present invention.
Figure 5:
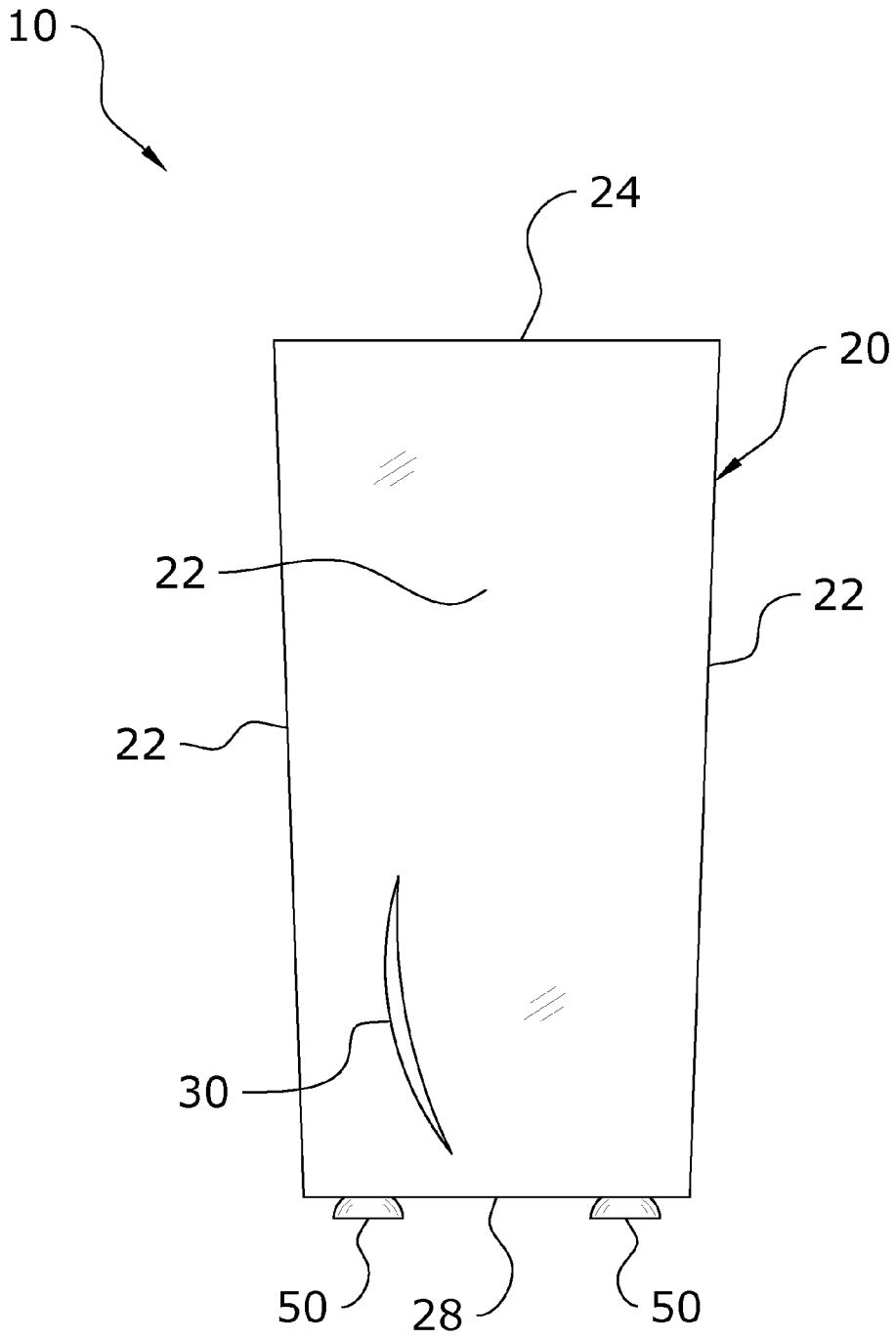
FIG. 5 is a left side view of the present invention.

The at least one vent is preferably comprised of at least one first vent 30 within the left sidewall and/or the right sidewall of the container 20 and at least one second vent 40 within the rear sidewall of the container 20. The first vent 30 is preferably comprised of an elongated opening such as a crescent shape as illustrated in FIG. 2 of the drawings. As illustrated in FIGS. 5 and 6 of the drawings, one first vent 30 extends into the left sidewall and a second first vent 30 extends through the right sidewall closer to the rear sidewall.

Figure 4:
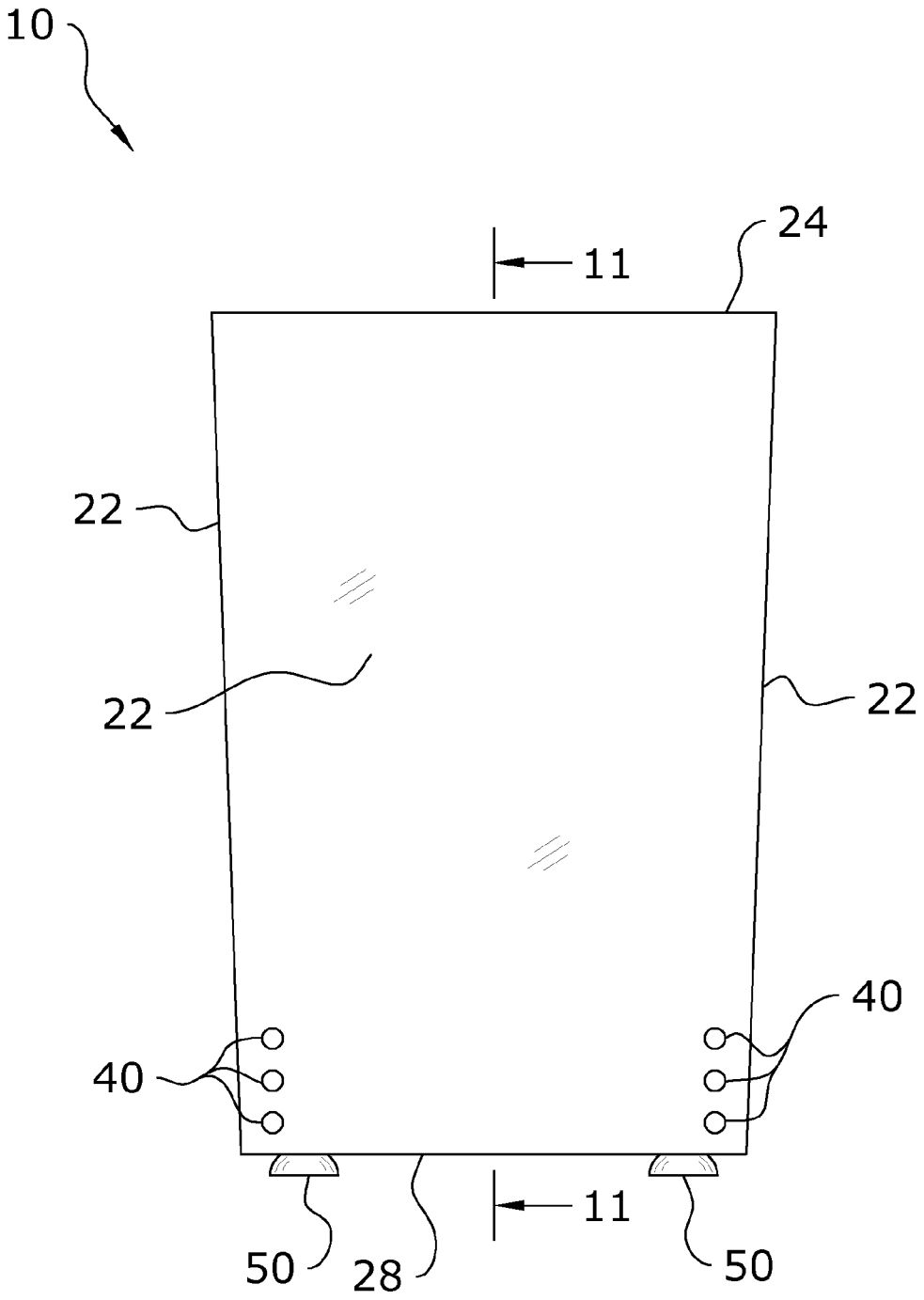
FIG. 4 is a rear view of the present invention.

The at least one second vent 40 is preferably comprised of a first vertical row of circular shaped apertures and a second vertical row of circular shaped apertures extending through the rear wall as illustrated in FIG. 4 of the drawings. The first vertical row is near the left sidewall and the second vertical row is near the right sidewall as further shown in FIG. 4 of the drawings. The location of the second vents 40 near the lower corner portions of the rear sidewall increases the likelihood that the second vents 40 will not become plugged by the trash bag 14.

E. Operation of Preferred Embodiment.

In use, the user determines a location that they would like the waste container 20 located on a floor 12. After positioning the container 20 in the desired location, the user then secures the suction cups 50 to the floor 12 thereby preventing movement of the container 20 with respect to the floor 12. For example, the container 20 is not movable in a horizontal direction or a vertical direction after the suction cups 50 are secured to the floor 12 using negative air pressure. The user then inserts the trash bag 14 into the interior cavity 27 of the container 20 and during insertion the air within the interior cavity 27 is displaced resulting in the displaced air being vented outwardly through the vents 30, 40. The user overlaps the trash bag 14 over the upper edge 24 and can then place waste material 16 into the trash bag 14 as illustrated in FIG. 13 of the drawings.

When the user wants to remove the trash bag 14 and the waste material 16 within, the user grasps the upper portion of the trash bag 14 and lifts upwardly. As the trash bag 14 is pulled upwardly, exterior air enters the interior cavity 27 via the vents 30, 40 thereby allowing the trash bag 14 to be easily lifted without creating negative air pressure between the trash bag 14 and the interior wall of the container 20 as illustrated in FIG. 14 of the drawings. The suction cups 50 also prevent movement of the container 20 during the removal of the trash bag 14 by preventing the upward lifting of the trash bag 14. It can be appreciated that the suction cups 50 are important to be used if no vents 30, 40 exist within the container 20. The user can then repeat the above process with another trash bag 14. If the user desires to move the container 20, they simply release the suction cups 50 from the floor 12 and move the container 20 to the desired location.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A waste container, comprising:

a container having a base, at least one sidewall extending upwardly from said base and an interior cavity formed by said base and said at least one sidewall, wherein said at least one sidewall has an upper edge surrounding an upper opening within said container; and at least one suction cup attached to a bottom surface of said base, wherein said at least one suction cup is removably attachable to an upper surface of a floor using negative fluid pressure.

2. The waste container of claim 1, wherein said base is comprised of a flat and horizontal structure.

3. The waste container of claim 1, wherein said at least one sidewall is comprised of four sidewalls connected together forming a tubular structure having a rectangular cross sectional area, wherein said four sidewalls are comprised of a left sidewall, a right sidewall, a front sidewall and a rear sidewall.

4. The waste container of claim 3, wherein said container includes at least one vent within said at least one sidewall.

5. The waste container of claim 3, including at least one first vent within said left sidewall and/or said right sidewall.

6. The waste container of claim 5, including at least one second vent within said rear sidewall.

7. The waste container of claim 6, wherein said at least one first vent and said at least one second vent are positioned at least one inch above an upper surface of said base.

8. The waste container of claim 7, wherein said at least one first vent is comprised of an elongated opening.

9. The waste container of claim 8, wherein said at least one first vent is comprised of a crescent shape.

10. The waste container of claim 9, wherein said at least one second vent is comprised of a first vertical row of circular shaped apertures.

11. The waste container of claim 10, wherein said at least one second vent is comprised of a second vertical row of circular shaped apertures, wherein said first vertical row is near said left sidewall and wherein said second vertical row is near said right sidewall.

12. The waste container of claim 3, wherein said base is rectangular shaped having four corners, wherein said at least one suction cup is comprised of four suction cups, and wherein each of said four suction cups are positioned near one of said four corners of said base.

13. The waste container of claim 1, wherein said at least one suction cup is comprised of a plurality of suction cups.

14. The waste container of claim 1, wherein said base includes at least one recessed portion extending upwardly into said bottom surface, wherein said at least one recessed portion receives at least a portion of said at least one suction cup.

15. The waste container of claim 14, wherein said at least one recessed portion has a circular shape and wherein said at least one suction cup has a circular shape.

16. The waste container of claim 1, wherein said at least one suction cup is comprised of a lever suction cup having a lever, wherein said lever is positionable in a released position to allow for the release of said at least one suction cup from said floor by releasing any negative fluid pressure within said at least one suction cup and wherein said lever is positionable in a locked position to create a negative fluid pressure within said at least one suction cup to secure said at least one suction cup to said floor.

17. The waste container of claim 16, wherein said lever is positioned within said interior cavity of said container.

18. The waste container of claim 17, wherein said base includes at least one recessed portion extending upwardly into said bottom surface, wherein said at least one recessed portion receives at least a portion of said at least one suction cup and wherein said lever is positioned above an upper surface of said base, wherein said lever engages said upper surface of said base when in said locked position to pull upwardly upon said at least one suction cup.

19. The waste container of claim 18, wherein said base is rectangular shaped having four corners, wherein said at least one suction cup is comprised of four suction cups, and wherein each of said four suction cups are positioned near one of said four corners of said base.

20. A waste container, comprising:

a container having a base, at least one sidewall extending upwardly from said base and an interior cavity formed by said base and said at least one sidewall, wherein said at least one sidewall has an upper edge surrounding an upper opening within said container;

wherein said base is comprised of a flat and horizontal structure;

wherein said at least one sidewall is comprised of four sidewalls connected together forming a tubular structure having a rectangular cross sectional area, wherein said four sidewalls are comprised of a left sidewall, a right sidewall, a front sidewall and a rear sidewall;

at least one suction cup attached to a bottom surface of said base, wherein said at least one suction cup is removably attachable to an upper surface of a floor using negative fluid pressure;

at least one first vent within said left sidewall and/or said right sidewall, wherein said at least one first vent is comprised of an elongated opening, wherein said at least one first vent is comprised of a crescent shape; and at least one second vent within said rear sidewall, wherein said at least one second vent is comprised of a first vertical row of circular shaped apertures and a second vertical row of circular shaped apertures, wherein said first vertical row is near said left sidewall and wherein said second vertical row is near said right sidewall;

wherein said at least one first vent and said at least one second vent are positioned at least one inch above an upper surface of said base;

wherein said base is rectangular shaped having four corners, wherein said at least one suction cup is comprised of four suction cups, and wherein each of said four suction cups are positioned near one of said four corners of said base;

wherein said base includes at least one recessed portion extending upwardly into said bottom surface, wherein said at least one recessed portion receives at least a portion of said at least one suction cup;

wherein said at least one recessed portion has a circular shape and wherein said at least one suction cup has a circular shape;

wherein said at least one suction cup is comprised of a lever suction cup having a lever, wherein said lever is positionable in a released position to allow for the release of said at least one suction cup from said floor by releasing any negative fluid pressure within said at least one suction cup and wherein said lever is positionable in a locked position to create a negative fluid pressure within said at least one suction cup to secure said at least one suction cup to said floor;

wherein said lever is positioned within said interior cavity of said container.

* * * * *